US008393829B2

(12) United States Patent
Taylor

(10) Patent No.: US 8,393,829 B2
(45) Date of Patent: Mar. 12, 2013

(54) WAVE ANCHOR SOIL REINFORCING CONNECTOR AND METHOD

(75) Inventor: Thomas P. Taylor, Colleyville, TX (US)

(73) Assignee: T&B Structural Systems LLC, Ft. Worth, TX (US)

( * ) Notice: Subject to any disclaimer, the term of this patent is extended or adjusted under 35 U.S.C. 154(b) by 345 days.

(21) Appl. No.: 12/684,479

(22) Filed: Jan. 8, 2010

(65) Prior Publication Data

US 2011/0170957 A1 Jul. 14, 2011

(51) Int. Cl.
*E02D 29/02* (2006.01)

(52) U.S. Cl. ..... 405/262; 405/284; 405/286

(58) Field of Classification Search ..... 405/262, 405/272, 284, 286, 287, 302.4; 29/525.01, 29/525.02, 525.11; 411/522, 530; 52/378–383
See application file for complete search history.

(56) References Cited

U.S. PATENT DOCUMENTS

| | | | |
|---|---|---|---|
| 991,041 | A | 5/1911 | Toennes |
| RE13,299 | E | 10/1911 | Denison |
| 1,144,143 | A | 6/1915 | McGillivray |
| 1,813,912 | A | 7/1931 | Clark |
| 1,959,816 | A | 5/1934 | Crum |
| 1,992,785 | A | 2/1935 | Steuer |
| 2,137,153 | A | 11/1938 | Brozek |
| 2,208,589 | A | 7/1940 | Leemhuis |
| 2,275,933 | A | 3/1942 | Werner |
| 2,316,712 | A | 4/1943 | Prince |
| 2,327,640 | A | 8/1943 | Hendry |
| 2,552,712 | A | 5/1951 | Ellis |
| 2,703,963 | A | 3/1955 | Gutierrez |
| 2,881,614 | A | 4/1959 | Preininger |
| 3,597,928 | A | 8/1971 | Pilaar |
| 3,680,748 | A | 8/1972 | Brunhuber |
| 3,998,022 | A | 12/1976 | Muse |
| 4,075,924 | A | 2/1978 | McSherry |
| 4,116,010 | A | 9/1978 | Vidal |
| 4,117,686 | A | 10/1978 | Hilfiker |
| 4,123,881 | A | 11/1978 | Muse |
| 4,134,241 | A | 1/1979 | Walton |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.
International Application No. PCT/US09/031494—International Search Report and Written Opinion dated Mar. 13, 2009.
International Application No. PCT/US09/44099—International Search Report and Written Opinion dated Aug. 12, 2009.
International Application No. PCT/US08/069011—International Preliminary Report on Patentability dated Jan. 21, 2010.
International Application No. PCT/US10/036991—International Search Report and Written Opinion dated Aug. 2, 2010.
International Application No. PCT/US09/44099—International Preliminary Report on Patentability dated Nov. 25, 2010.

(Continued)

*Primary Examiner* — Sean Andrish
(74) *Attorney, Agent, or Firm* — Edmonds & Nolte, PC

(57) ABSTRACT

A facing anchor assembly for securing a facing to a soil reinforcing element, the facing anchor assembly including first and second horizontally-disposed plates vertically-offset from each other and having at least one transverse protrusion disposed on each plate. The transverse protrusions can receive and seat at least one transverse wire of the soil reinforcing element and a coupling assembly can be configured to secure the at least one transverse wire in place, and also frictionally engage a pair of longitudinal wires of the soil reinforcing element between the first and second horizontally-disposed plates, thereby preventing removal of the soil reinforcing element.

5 Claims, 6 Drawing Sheets

U.S. PATENT DOCUMENTS

| | | | | |
|---|---|---|---|---|
| 4,286,895 | A | 9/1981 | Poli | |
| 4,324,508 | A | 4/1982 | Hilfiker | |
| 4,329,089 | A | 5/1982 | Hilfiker | |
| 4,341,491 | A | 7/1982 | Neumann | |
| 4,343,572 | A | 8/1982 | Hilfiker | |
| 4,391,557 | A | 7/1983 | Hilfiker | |
| 4,411,255 | A | 10/1983 | Lee | |
| 4,470,728 | A | 9/1984 | Broadbent | |
| 4,505,621 | A | 3/1985 | Hilfiker | |
| 4,514,113 | A * | 4/1985 | Neumann | 405/286 |
| 4,616,959 | A | 10/1986 | Hilfiker | |
| 4,643,618 | A | 2/1987 | Hilfiker | |
| 4,651,975 | A | 3/1987 | Howell | |
| 4,653,962 | A | 3/1987 | McKittrick | |
| 4,661,023 | A | 4/1987 | Hilfiker | |
| 4,664,552 | A | 5/1987 | Schaaf | |
| 4,710,062 | A | 12/1987 | Vidal | |
| 4,725,170 | A | 2/1988 | Davis | |
| 4,834,584 | A | 5/1989 | Hilfiker | |
| 4,856,939 | A | 8/1989 | Hilfiker | |
| 4,914,876 | A | 4/1990 | Forsberg | |
| 4,920,712 | A | 5/1990 | Dean, Jr. | |
| 4,929,125 | A | 5/1990 | Hilfiker | |
| 4,952,098 | A | 8/1990 | Grayson | |
| 4,961,673 | A | 10/1990 | Pagano | |
| 4,968,186 | A | 11/1990 | Ogorchock | |
| 4,993,879 | A | 2/1991 | Hilfiker | |
| 5,044,833 | A | 9/1991 | Wilfiker | |
| 5,066,169 | A | 11/1991 | Gavin | |
| 5,076,735 | A | 12/1991 | Hilfiker | |
| 5,139,369 | A | 8/1992 | Jaecklin | |
| 5,156,496 | A | 10/1992 | Vidal | |
| 5,190,413 | A | 3/1993 | Carey | |
| 5,207,038 | A | 5/1993 | Negri | |
| RE34,314 | E | 7/1993 | Forsberg | |
| 5,257,880 | A | 11/1993 | Janopaul | |
| 5,259,704 | A | 11/1993 | Orgorchock | |
| 5,417,523 | A | 5/1995 | Scales | |
| 5,451,120 | A | 9/1995 | Martinez-Gonzalez | |
| 5,456,554 | A | 10/1995 | Barrett | |
| 5,474,405 | A | 12/1995 | Anderson | |
| D366,191 | S | 1/1996 | Gay | |
| 5,484,235 | A | 1/1996 | Hilfiker | |
| 5,487,623 | A | 1/1996 | Anderson | |
| 5,494,379 | A | 2/1996 | Anderson | |
| 5,507,599 | A | 4/1996 | Anderson | |
| 5,522,682 | A | 6/1996 | Egan | |
| 5,525,014 | A | 6/1996 | Brown | |
| 5,531,547 | A | 7/1996 | Shimada | |
| 5,533,839 | A | 7/1996 | Shimada | |
| 5,582,492 | A | 12/1996 | Doyle | |
| 5,622,455 | A | 4/1997 | Anderson | |
| 5,702,208 | A | 12/1997 | Hilfiker | |
| 5,722,799 | A | 3/1998 | Hilfiker | |
| 5,730,559 | A | 3/1998 | Anderson | |
| 5,733,072 | A | 3/1998 | Hilfiker | |
| D393,989 | S | 5/1998 | Groves | |
| 5,749,680 | A | 5/1998 | Hilfiker | |
| 5,797,706 | A | 8/1998 | Segrestin | |
| 5,807,030 | A | 9/1998 | Anderson | |
| 5,820,305 | A | 10/1998 | Taylor | |
| 5,947,643 | A | 9/1999 | Anderson | |
| 5,951,209 | A | 9/1999 | Anderson | |
| 5,971,699 | A | 10/1999 | Winski | |
| 5,975,809 | A | 11/1999 | Taylor | |
| 5,975,810 | A | 11/1999 | Taylor | |
| 6,024,516 | A | 2/2000 | Taylor | |
| 6,050,748 | A | 4/2000 | Anderson | |
| 6,079,908 | A | 6/2000 | Anderson | |
| 6,086,288 | A | 7/2000 | Ruel | |
| D433,291 | S | 11/2000 | Shamoon | |
| 6,186,703 | B1 | 2/2001 | Shaw | |
| 6,336,773 | B1 | 1/2002 | Anderson | |
| 6,345,934 | B1 | 2/2002 | Jailoux | |
| 6,357,970 | B1 | 3/2002 | Hilfiker | |
| 6,517,293 | B2 | 2/2003 | Taylor | |
| 6,595,726 | B1 | 7/2003 | Egan | |
| 6,793,436 | B1 | 9/2004 | Ruel | |
| 6,802,675 | B2 | 10/2004 | Timmons et al. | |
| 6,857,823 | B1 | 2/2005 | Hilfiker | |
| 6,939,087 | B2 | 9/2005 | Ruel | |
| 7,033,118 | B2 | 4/2006 | Hilfiker | |
| 7,073,983 | B2 | 7/2006 | Hilfiker | |
| 7,270,502 | B2 | 9/2007 | Brown | |
| 7,281,882 | B2 | 10/2007 | Hilfiker | |
| 7,399,144 | B2 | 7/2008 | Kallen | |
| D599,630 | S | 9/2009 | Taylor | |
| 7,722,296 | B1 | 5/2010 | Taylor | |
| 7,891,912 | B2 | 2/2011 | Taylor | |
| 7,972,086 | B2 | 7/2011 | Taylor | |
| 7,980,790 | B2 | 7/2011 | Taylor | |
| 8,079,782 | B1 * | 12/2011 | Hilfiker et al. | 405/262 |
| 2002/0044840 | A1 | 4/2002 | Taylor | |
| 2002/0067959 | A1 * | 6/2002 | Thornton | 405/262 |
| 2003/0223825 | A1 | 12/2003 | Timmons | |
| 2004/0018061 | A1 | 1/2004 | Jannsson | |
| 2004/0161306 | A1 | 8/2004 | Ruel | |
| 2004/0179902 | A1 | 9/2004 | Ruel | |
| 2005/0111921 | A1 | 5/2005 | Taylor | |
| 2005/0163574 | A1 | 7/2005 | Hilfiker | |
| 2005/0271478 | A1 | 12/2005 | Ferraiolo | |
| 2005/0286981 | A1 | 12/2005 | Robertson | |
| 2006/0204342 | A1 | 9/2006 | Hifiker | |
| 2006/0239783 | A1 | 10/2006 | Kallen | |
| 2007/0014638 | A1 | 1/2007 | Brown | |
| 2009/0016825 | A1 | 1/2009 | Taylor | |
| 2009/0067933 | A1 | 3/2009 | Taylor | |
| 2009/0285639 | A1 | 11/2009 | Taylor | |
| 2009/0304456 | A1 | 12/2009 | Taylor | |
| 2010/0247248 | A1 | 9/2010 | Taylor | |
| 2011/0170957 | A1 | 7/2011 | Taylor | |
| 2011/0170958 | A1 | 7/2011 | Taylor | |
| 2011/0170960 | A1 | 7/2011 | Taylor | |
| 2011/0229274 | A1 | 9/2011 | Taylor | |
| 2011/0311317 | A1 | 12/2011 | Taylor | |
| 2011/0311318 | A1 | 12/2011 | Taylor | |

FOREIGN PATENT DOCUMENTS

| | | |
|---|---|---|
| FR | 530097 | 9/1921 |
| FR | 1006087 | 1/1952 |
| JP | 3114014 | 6/1991 |
| JP | 08209703 | 8/1996 |
| JP | 08326074 | 12/1996 |
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

WAVE ANCHOR SOIL REINFORCING CONNECTOR AND METHOD

BACKGROUND OF THE DISCLOSURE

Retaining wall structures that use horizontally positioned soil inclusions to reinforce an earth mass in combination with a facing element are referred to as Mechanically Stabilized Earth (MSE) structures. MSE structures can be used for various applications including retaining walls, bridge abutments, dams, seawalls, and dikes.

The basic MSE technology is a repetitive process where layers of backfill and horizontally placed soil reinforcing elements are positioned one atop the other until a desired height of the earthen structure is achieved. Typically, grid-like steel mats or welded wire mesh are used as earthen reinforcement elements. In most applications, the reinforcing mats consist of parallel transversely extending wires welded to parallel longitudinally extending wires, thus forming a grid-like mat or structure. Backfill material and the soil reinforcing mats are combined and compacted in series to form a solid earthen structure, taking the form of a standing earthen wall.

In some instances, a substantially vertical wall, typically made of concrete or steel facing panels, may then be constructed a short distance from the standing earthen wall. The vertical wall not only serves as decorative architecture, but also prevents erosion at the face of the earthen wall. The soil reinforcing mats extending from the compacted backfill may then be attached directly to the back face of the vertical wall in a variety of configurations. To facilitate the connection to the earthen formation, the vertical wall will frequently include a plurality of "facing anchors" either cast into or attached somehow to the back face of the wall at predetermined and/or spaced-apart locations. Each facing anchor is typically positioned so as to correspond with and couple directly to the end of a soil reinforcing mat. Via this attachment, outward movement and shifting of the vertical wall is significantly reduced.

Although there are several methods of attaching soil reinforcing elements to facing structures, it nonetheless remains desirable to find improved anchors and anchor-designs offering less expensive alternatives and greater resistance to shear forces inherent in such structures.

SUMMARY OF THE DISCLOSURE

Embodiments of the disclosure may provide a facing anchor assembly for securing a facing to a soil reinforcing element. The facing anchor may include a first horizontally-disposed plate and a second horizontally-disposed plate vertically-offset from the first horizontally-disposed plate, where each horizontally disposed plate has a first end and a second end. At least one transverse protrusion can be disposed between the first end and the second end of each horizontally-disposed plate, wherein the at least one transverse protrusion is configured to receive and seat a first transverse wire of the soil reinforcing element. A coupling assembly may be configured to secure the first transverse wire within the at least one transverse protrusion and further engage a pair of longitudinal wires of the soil reinforcing element between the first and second horizontally-disposed plates, thereby preventing removal of the soil reinforcing element.

Other embodiments of the disclosure may provide a swiveling facing anchor assembly for securing a facing to a soil reinforcing element. The swiveling facing anchor assembly may include a first horizontally-disposed plate and a second horizontally-disposed plate vertically-offset from the first horizontally-disposed plate, wherein each horizontally disposed plate has a first end and a second end, a swivel plate having a first end and a second end, the first end of the swivel plate being configured to be coupled to the second end of the first and second horizontally-disposed plates, and at least one transverse protrusion disposed between the first and second ends of the swivel plate, wherein the at least one transverse protrusion is configured to receive and seat a first transverse wire of the soil reinforcing element. The swiveling facing anchor may also include a retainer plate configured to be coupled to the second end of the swivel plate and engage a pair of longitudinal wires of the soil reinforcing element between the retainer plate and the swivel plate, a first coupling assembly adapted to pivotably secure the swivel plate between the first and second horizontally disposed plates, and a second coupling assembly configured to secure the first transverse wire within the at least one transverse protrusion and further bind the pair of longitudinal wires of the soil reinforcing element between swivel plate and the retainer plate, thereby preventing removal of the soil reinforcing element.

Other embodiments of the disclosure may provide a method of securing a facing to a soil reinforcing element. The exemplary method may include providing a first horizontally-disposed plate and a second horizontally-disposed plate vertically-offset from the first horizontally-disposed plate, where each horizontally disposed plate has a first end and a second end. The method may further include seating at least one transverse wire of the soil reinforcing element into at least one transverse protrusion disposed between the first end and the second end of each horizontally-disposed plate. Moreover, the method may include securing the at least one transverse wire within the at least one transverse protrusion with a coupling assembly, wherein the coupling assembly is further configured to engage a pair of longitudinal wires of the soil reinforcing element between the first and second horizontally-disposed plates, thereby preventing removal of the soil reinforcing element.

DETAILED DESCRIPTION

Figure 1A:
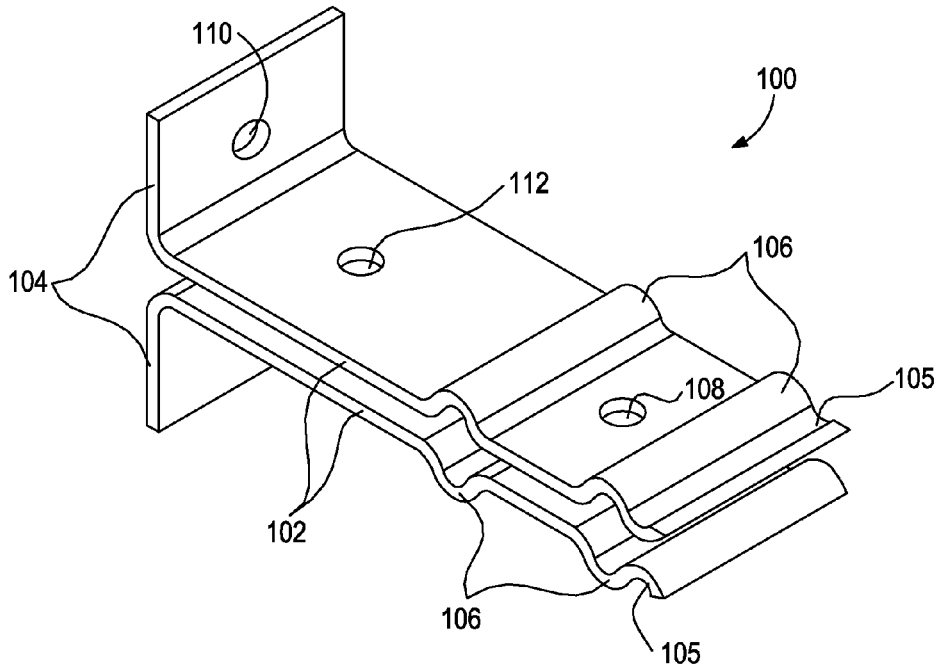
FIG. 1A is an isometric view of an exemplary facing anchor assembly, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Figure 1B:
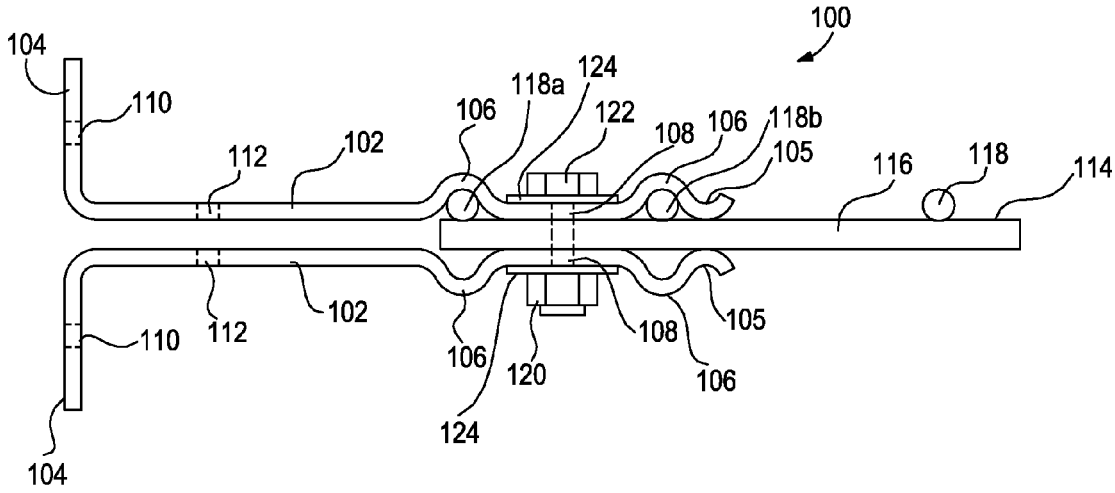
FIG. 1B is a side view of the assembly shown in FIG. 1A.
Figure 1C:
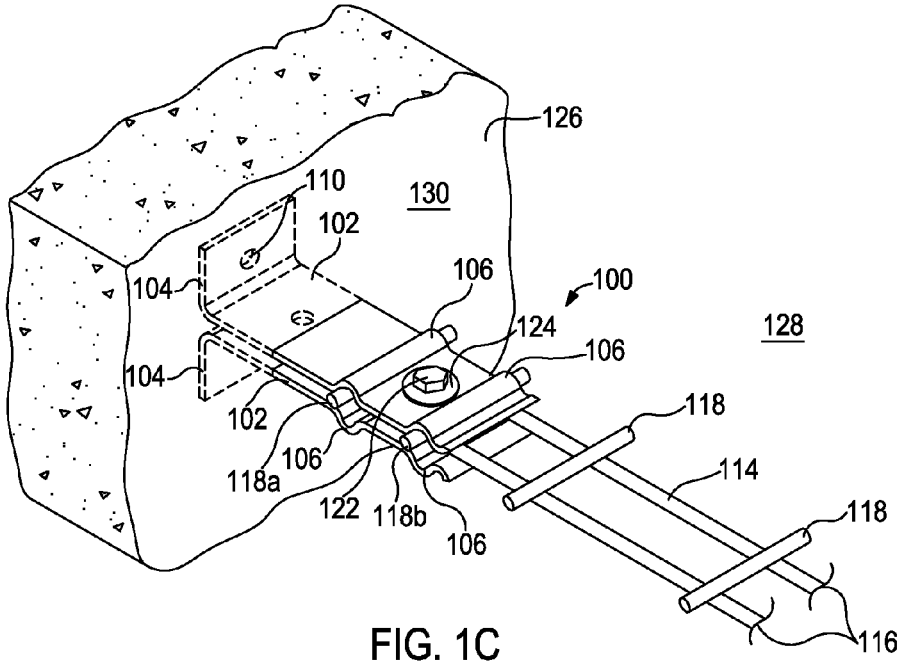
FIG. 1C is an isometric view of the exemplary facing anchor assembly of FIG. 1 connected to a soil reinforcing element and facing, according to one or more aspects of the present disclosure.

Referring to FIGS. 1A-1C, illustrated is an exemplary facing anchor assembly 100 according to one or more embodiments of the present disclosure. In at least one embodiment, the facing anchor assembly 100 may include a pair of plates 102 that can be horizontally-disposed when in exemplary operation. Each plate 102 may be made of carbon steel, such as a low allow steel, but may also be manufactured from other high-strength materials exhibiting similar strength characteristics, such as ceramics or high-strength plastics. Furthermore, each plate 102 may have a vertically-disposed tab 104 at one end and define a trough 105 at the other end. Interposed between the tab 104 and the trough 105 of each plate 102 may be at least two longitudinally-offset transverse protrusions 106. At least one coupling perforation 108 located between the transverse protrusions 106 can be defined in each plate 102. Moreover, at least one facing perforation 110 may be defined on each tab 104 and at least one plate perforation 112 may be defined between the tab 104 and the transverse protrusion 106 closest to the tab 104.

In one or more embodiments, the facing anchor assembly 100 may be configured to receive and secure a soil reinforcing element 114 (FIGS. 1B and 1C). An exemplary soil reinforcing element 114 may encompass a welded wire grid having at least two longitudinal wires 116 disposed substantially parallel to each other, and a series of transverse wires 118 welded to the longitudinal wires 116 in a generally perpendicular fashion. In an exemplary embodiment, the spacing between each longitudinal wire 116 may be about 2 in. to about 4 in., while the spacing between each transverse wire 118 may be about bin. As can be appreciated, however, the particular spacing and configuration of the longitudinal wires 116 and transverse wires 118 may vary to accommodate an assortment of MSE applications.

As illustrated in FIGS. 1B and 1C, a first transverse wire 118*a* and a second transverse wire 118*b* may be captured and seated within the longitudinally-offset transverse protrusions 106 of at least one plate 102. In other exemplary embodiments, the first and second transverse wires 118*a,b* may be located on the underside of the soil reinforcing element 114, thereby capturing and seating the transverse wires 118*a,b* in the transverse protrusions 106 of the opposing plate 102. Moreover, even other exemplary embodiments (not illustrated herein) may include soil reinforcing elements 114 with transverse wires 118 attached to both the top and the bottom portions of the longitudinal wires 116, thereby seating transverse wires 118 in each transverse protrusion 106 of each plate 102.

The coupling perforations 108 of each plate 102 may be used to secure the soil reinforcing element 114 within the transverse protrusions 106. For example, as illustrated in FIG. 1B, a nut 120 and bolt 122 assembly, including washers 124 disposed on either side, may be used to tighten down on the soil reinforcing element 114. In exemplary operation, tightening the nut 120 and bolt 122 assembly may effectively prevent the removal of the first and second transverse wires 118*a,b* from the transverse protrusions 106 of at least one plate 102. This may also serve to clamp the longitudinal wires 116 between the two plates 102, thereby creating a frictional engagement therebetween.

As can be appreciated, securing the first and second transverse wires 118*a,b* within the transverse protrusions 106 may provide an equal distribution of shear stress along the length of the transverse wires 118*a,b*, instead of focusing shear forces at a singular weld point. Moreover, clamping the longitudinal wires 116 between the plates 102 may serve to distribute tensile forces between each longitudinal wire 116, instead of relying on a single wire during MSE shifting.

Referring to FIG. 1C, the exemplary facing anchor assembly 100 may be used to secure a facing 126 to an earthen formation 128. The earthen formation 128 may encompass an MSE structure having a plurality of soil reinforcing elements 114 extending horizontally into the earthen formation 128 to add tensile capacity thereto. The facing 126 may generally define an exposed face (not shown) and a back face 130; the exposed face may encompass a decorative architectural facing and the back face 130 may be located adjacent to the earthen formation 128. In one or more embodiments, the facing 126 may consist of an individual precast concrete panel or, alternatively, a plurality of interlocking precast concrete modules or wall members that are assembled into interlocking relationship. In another embodiment, the precast concrete panels may be replaced with a uniform, unbroken expanse of concrete or the like which may be poured on site.

In at least one embodiment, a portion of the facing anchor assembly 100 may be cast directly into the facing 126 to secure the assembly 100 against removal. As illustrated, the tabs 104 of each plate 102 may be part of the portion cast into the facing 126 and may serve to provide rigidity and stability to the resulting connection. The plates 102 may be cast into the facing 126 and vertically offset from each other to accommodate the receipt of the soil reinforcing element 114 therein. The resulting gap created between the adjacent plates 102 may generally flex to allow entry of an element 114.

In another exemplary embodiment, the plates 102 may not be cast into the facing 126, but may be bolted, or otherwise attached, directly to the back face 130. For example, holes may be drilled into the concrete facing 126 and configured to receive a bolt and washer assembly (not shown) in conjunction with the facing perforations 110 defined on each tab 104.

Figure 2A:
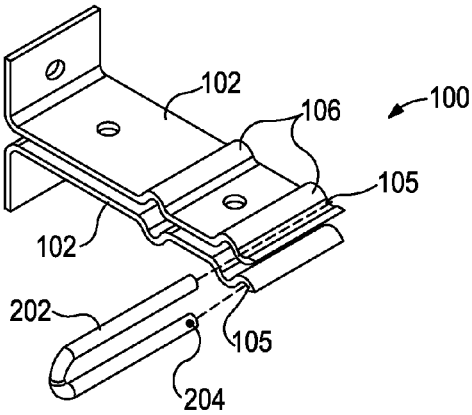
FIG. 2A is an isometric view of the exemplary facing anchor assembly of FIG. 1 with an exemplary connection apparatus, according to one or more aspects of the present disclosure.
Figure 2B:
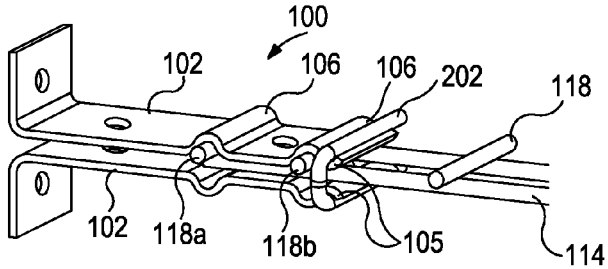
FIG. 2B is an isometric view of the assembly of FIG. 2A, where the exemplary connection apparatus is engaged, according to one or more aspects of the present disclosure.

Referring now to FIGS. 2A and 2B, illustrated is another exemplary embodiment of securing a soil reinforcing element 114 to the facing anchor assembly 100. As illustrated, a U-shaped connector pin 202 may be inserted into the respective troughs 105 defined on each plate 102, thereby holding the ends of the plates 102 together and securing the first and second transverse wires 118*a,b* against removal from the transverse protrusions 106. In one or more embodiments, the connector pin 202 may be made of steel bar-stock or a bent length of rebar or molded from high strength plastic. Furthermore, each leg of the U-shaped connector pin 202 may include a small bead 204 disposed on the inside portion of the end of each leg. In one or more embodiments, the bead 204 may include a small globule of welded material and may be configured to prevent removal of the connector pin 202 once engaged with the troughs 105. Further, the U-shaped connector pin 202 may have at least one end that is cold-formed to create a knob (not shown) configured to prevent the removal of the connector pin 202 once engaged with the troughs 105. As can be appreciated, the nut 120 and bolt 122 assembly would not be required in this exemplary embodiment, thus reducing the number of loose parts needed to make a secure connection.

Figure 3:
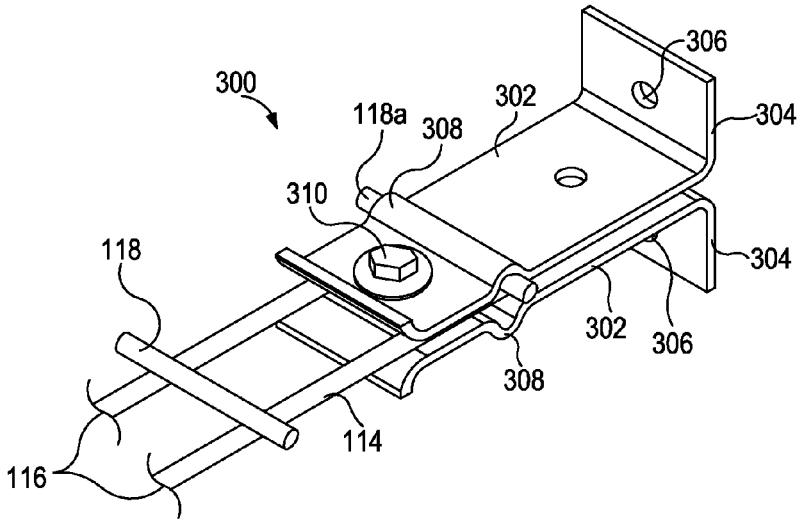
FIG. 3 is an isometric view of an exemplary facing anchor configuration, according to one or more aspects of the present disclosure.

Referring now to FIG. 3, illustrated is another exemplary embodiment of a facing anchor assembly 300, according to one or more embodiments of the disclosure. In at least one embodiment, the facing anchor assembly 300 may include a pair of plates 302 that can be horizontally-disposed during operation. Similar to the facing anchor assembly 100 described above, each plate 302 may include a vertically-disposed tab 304 having at least one plate perforation 306 defined therein that may be used to directly couple to the back face 130 of a facing 126 (see FIG. 1C). Each plate 302 may also include a single, longitudinally-offset transverse protrusion 308 for receiving and seating a first transverse wire 118*a* attached or otherwise coupled to a pair of longitudinal wires 116 of a soil reinforcing element 114.

As illustrated, the transverse protrusion 308 of the top plate 302 may receive the first transverse wire 118*a*, but in other exemplary applications the transverse wires 118 may be located on the underside of the soil reinforcing element 114, thus the first transverse wire 118*a* may be captured and seated within the transverse protrusions 308 of the opposing bottom plate 302. Moreover, other applications (not specifically illustrated herein) may include soil reinforcing elements 114 with transverse wires 118 attached to both the top and the bottom of the longitudinal wires 116, thereby seating transverse wires 118 in the transverse protrusion 308 of each plate 302.

A coupling assembly 310 can be used to clamp the longitudinal wires 116 between the plates 302, thereby creating a frictional engagement configured to prevent the removal of the soil reinforcing element 114 from the facing anchor assembly 300. Clamping the longitudinal wires 116 between the plates 302 may also securely seat the first transverse wire 118*a* within the transverse protrusion 308, thereby providing equal shear stress distribution along the length of the transverse wire 118*a* and further preventing the removal of the first transverse wire 118*a* from the facing anchor assembly 300.

Figure 4A:
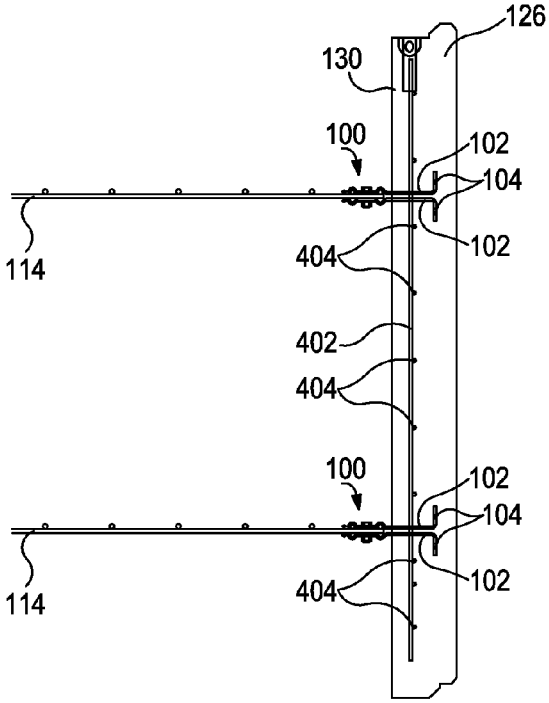
FIG. 4A is a side view depicting an exemplary connection of the facing anchor assembly to a facing, according to one or more aspects of the present disclosure.
Figure 4B:
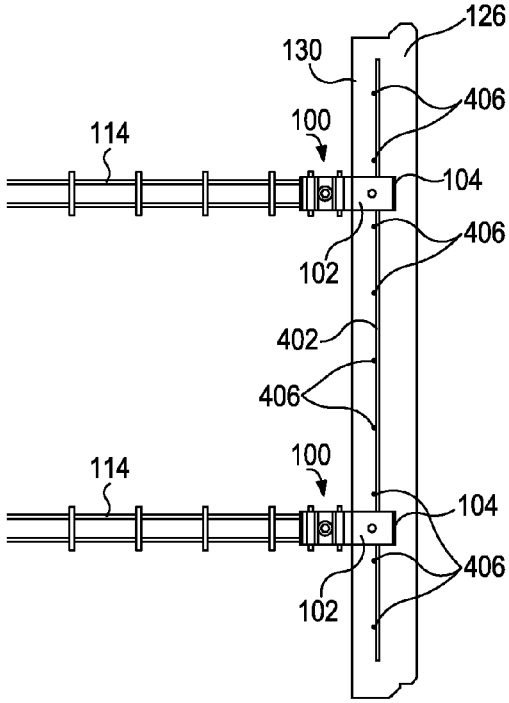
FIG. 4B is a top plan view depicting an exemplary connection of the facing anchor assembly to a facing, according to one or more aspects of the present disclosure.

Referring now to FIGS. 4A and 4B, illustrated is an exemplary configuration of connecting at least two soil reinforcing elements 114 to a corresponding exemplary facing anchor assembly 100, as generally described herein. Specifically, FIG. 4A depicts a side view of a connection configuration including two soil reinforcing elements 114 vertically-offset from each other. FIG. 4B depicts a top view of a connection configuration including two soil reinforcing elements 114 horizontally-offset from each other. As can be appreciated, the offset distance between each soil reinforcing element connection may depend on the specific application or stress requirements.

In the illustrated exemplary embodiment, the plates 102 of the facing anchor assembly 100 can be cast into the back face 130 of the facing 126, as discussed above with reference to FIG. 1C. In other embodiments, the plates 102 may be bolted directly to the back face 130, as also discussed above. In at least one embodiment, the facing 126 may include a concrete panel or wall having reinforcing 402 cast therein to provide added reinforcement and tensile strength to the facing 126. The reinforcing 402 can include a plurality of transverse members 404 and a plurality of horizontal members 406, thereby forming a grid. Moreover, the reinforcing 402 may be cast into the facing 126 in front of the tabs 104 of the plates 102 to provide additional lateral strength for the anchor assembly 100 by adding supplementary resistance to being pulled out of the concrete.

Figure 5A:
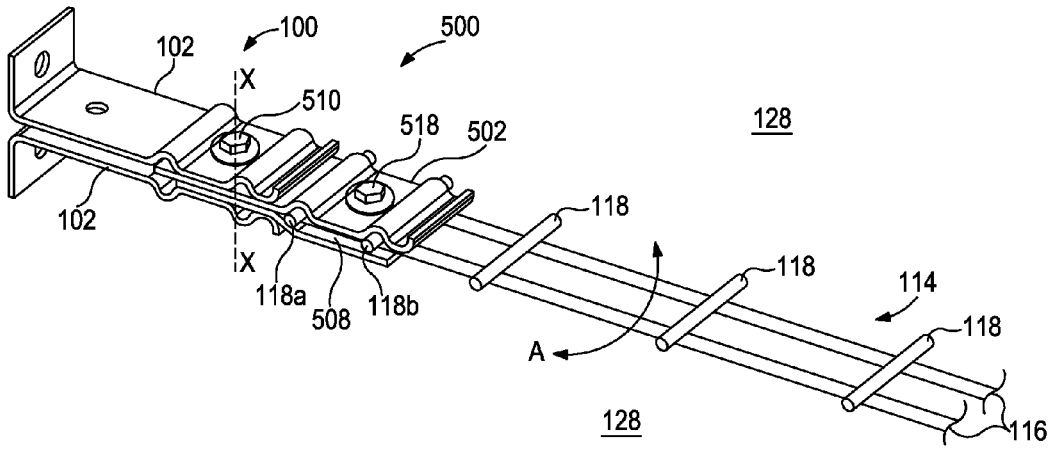
FIG. 5A is an isometric view of an exemplary facing anchor configuration, according to one or more aspects of the present disclosure.
Figure 5B:
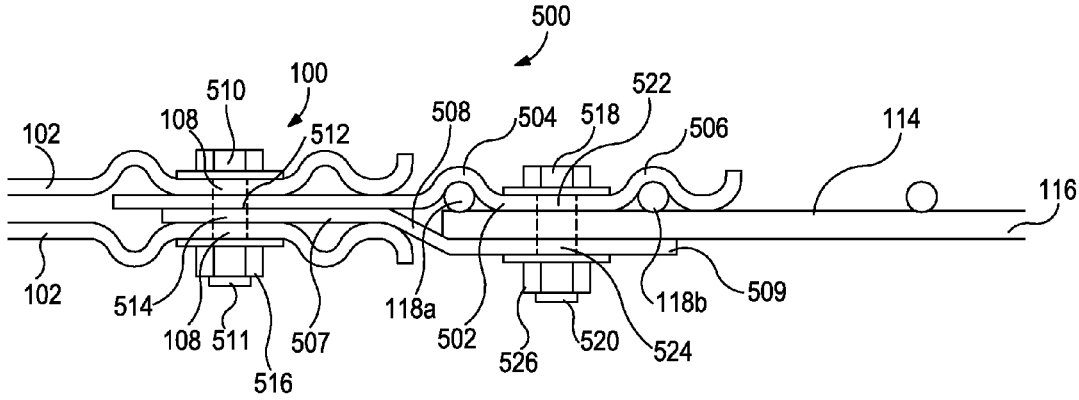
FIG. 5B is a side view the exemplary facing anchor configuration depicted in FIG. 5A.

Referring now to FIGS. 5A and 5B, illustrated is an exemplary embodiment of a swiveling facing anchor 500 that may provide a soil reinforcing element 114 connection that is capable of swiveling in a horizontal plane. Employing the exemplary swiveling facing anchor 500 may prove advantageous in MSE areas where a vertical obstruction, such as a drainage pipe, catch basin, bridge pile, or bridge pier may be encountered in the MSE field. To avoid such obstructions, the soil reinforcing element 114 may simply swivel out of range of the obstruction, yet maintain a secure connection.

As illustrated, the swiveling facing anchor 500 may generally include the facing anchor assembly 100, as described above, but may also include a swivel plate 502 and a retainer plate 508. The swivel plate 502 may have a first transverse protrusion 504 and a second transverse protrusion 506 for seating and securing first and second transverse wires 118*a,b*. As can be appreciated, other embodiments may include a swivel plate 502 having more or less transverse protrusions 506 to fit a variety of applications. The retainer plate 508 may include a first elevation 507 at a first end bound in conjunction with the facing anchor assembly 100, and a second elevation 509 at a second end bound in conjunction with the swivel plate 502. In at least one embodiment, the retainer plate 508 may be configured to provide a binding surface where the longitudinal wires 116 of the soil reinforcing element 114 can be clamped to the swivel plate 502. In other exemplary embodiments, the retainer plate 508 may simply include the second elevation 509 to provide the binding engagement to the longitudinal wires 116.

The swiveling facing anchor may further include a first coupling assembly 510 and a second coupling assembly 518. The first coupling assembly 510 may be used to couple the facing anchor assembly 100 to both the swivel plate 502 and the retainer plate 508. In at least one embodiment, the first coupling assembly 510 may include a bolt 511 and nut 516 assembly having a washer disposed at each end, but may also include other means of mechanical coupling without departing from the scope of the disclosure. In an exemplary embodiment, the bolt 511 may be extended through the coupling perforation 108 defined in each plate 102 and also extended through separate concentric perforations 512,514 defined in both the swivel plate 502 and the retainer plate 508, respectively. The nut 516 may be tightened onto the bolt 511 to secure the swivel plate 502 and the retainer plate 508 from removal.

The second coupling assembly 518 may be substantially similar to the first coupling assembly 510 and may be used to couple the swivel plate 502 to the retainer plate 508, and also may serve to seat the first and second transverse wires 118*a,b* within the first and second transverse protrusions 504,506, respectively. As described above, coupling the swivel plate 502 to the retainer plate 508 may also provide a binding engagement to the longitudinal wires 116 of the soil reinforcing element 114. A bolt 520 of the second coupling assembly 518 may be extended through a coupling perforation 522 defined in the swivel plate 502, and also extended through a retainer perforation 524 defined in the retainer plate 508. A nut 526 may be tightened onto the bolt 520 to effectively clamp down on the longitudinal wires 116, thereby creating a frictional engagement configured to prevent the removal of the soil reinforcing element 114.

Referring to FIG. 5A, before completely tightening the first coupling assembly 510, the soil reinforcing element 114 may be pivoted within the earthen formation 128 to avoid any vertical obstructions present therein. For example, the soil reinforcing element 114, including the swivel plate 502 and retainer plate 508 coupled thereto, may rotate or swivel about an axis X and rotatingly translate along a horizontal plane in the direction of arrow A. Once the element 114 is positioned in an adequate location avoiding MSE mass obstructions, the first coupling assembly 510 may be fully tightened for permanent use.

Figure 6:
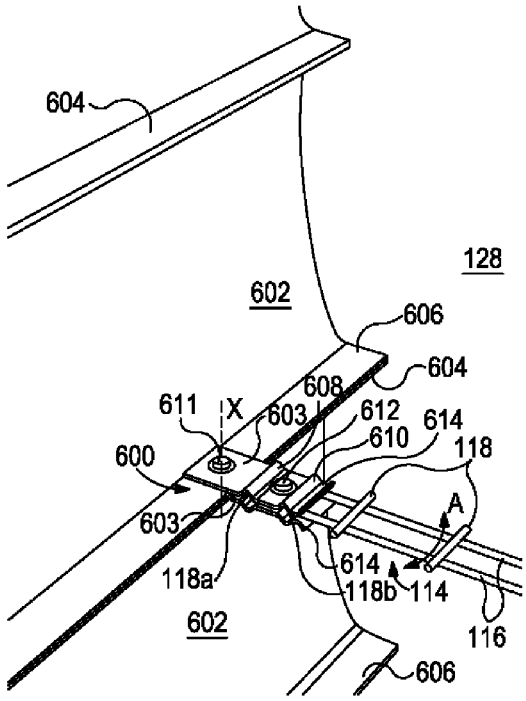
FIG. 6 is an isometric view of an exemplary facing anchor connection configuration, according to one or more aspects of the present disclosure.

Referring now to FIG. 6, depicted is another exemplary embodiment of a swiveling facing anchor 600. The exemplary swiveling facing anchor 600 may be configured to be coupled or otherwise secured to a rigid facing 602 adjacent to an earthen formation 128. In at least one embodiment, the rigid facing 602 may be made of steel, while in other embodiments the rigid facing 602 may be made of a high-strength plastic. Each rigid facing 602 may include a first lip 604 vertically-offset from a second lip 606, wherein each lip 604,606 extends toward the earthen formation 128 and provides a surface where the lips 604,606 of succeeding rigid facings 602 may be coupled together and stacked one atop the other to form a substantially vertical wall.

The exemplary swiveling facing anchor 600 may include a pair of swivel plates 603, substantially similar to the swivel plate 502 generally described with reference to FIGS. 5A and 5B above. In one or more embodiments, each swivel plate 603 may include a first transverse protrusion 608 and a second transverse protrusion 610 for seating and securing first and second transverse wires 118*a,b* of a soil reinforcing element 114.

A first coupling assembly 611 may be used to couple the pair of swivel plates 603 to the rigid facing 602 via a stacked engagement of a first lip 604 and a second lip 606 of succeeding rigid facings 602. In at least one embodiment, the first coupling assembly 611 may include a bolt and nut assembly having a washer disposed at each end, but may also include other means of mechanical coupling without departing from the scope of the disclosure. In an exemplary embodiment, a bolt (not labeled) of the coupling assembly 611 may be extended through concentric perforations defined in each swivel plate 603 and also defined in the first and second lips 604,606 of succeeding rigid facings 602. As illustrated, the swivel plates 603 may be coupled adjacent the top and the bottom of the first and second lips 604,606 of succeeding rigid facings 602, thereby forming a secure engagement with succeeding rigid facings 602. A nut (not shown) may then be tightened onto the end of the bolt to clamp the swivel plates 603 to the first and second lips 604,606 of succeeding rigid facings 602.

A second coupling assembly 612 may be used to seat the first and second transverse wires 118*a,b* within first and second transverse protrusions 608,610 of at least one swivel plate 603. In at least one embodiment, the second coupling assembly 612 may be substantially similar to the first coupling assembly 611, wherein a bolt (not labeled) may be extended through coupling perforations (not shown) in each swivel plate 603 and a nut (not shown) may be tightened onto the end of the bolt to clamp down on the longitudinal wires 116. Tightly securing the second coupling assembly 612 may create a frictional engagement configured to prevent the removal of the soil reinforcing element 114.

In another exemplary embodiment, not illustrated herein, the first and second transverse wires 118*a,b* may be secured against removal using the U-shaped connector pin 202, as generally described with reference to FIGS. 2A and 2B. Specifically, each swivel plate 603 may also define a trough 614 configured to receive a leg of the connector pin 202 (see FIG. 2A). As can be appreciated, the connector pin 202 may serve to hold the ends of the swivel plates 603 together, thereby securing the first and second transverse wires 118*a,b* against removal from the transverse protrusions 608,604 of either swivel plate 603.

Before completely tightening the first coupling assembly 611, the soil reinforcing element 114 may be pivoted within the earthen formation 128 to avoid any vertical obstructions present therein. In an exemplary embodiment, the soil reinforcing element 114, including the swivel plates 603 coupled thereto, may rotate or swivel about an axis X and rotatingly translate along a horizontal plane in the direction of arrow A. Once the element 114 is positioned in an adequate location avoiding MSE mass obstructions, the first coupling assembly 611 may be fully tightened for permanent use.

Referring now to FIGS. 7A-7D, illustrated is yet another exemplary facing anchor 700 that may be used to secure a soil reinforcing element 114 to a facing 702. In one or more embodiments, the facing 702 (see FIGS. 7C and 7D) may include a vertically-disposed, welded wire grid having a series of vertical wires 704 welded or otherwise coupled to a series of horizontal wires 706. The facing 702 may be secured to an earthen formation (not shown) via a connection between the facing anchor 700 and the soil reinforcing elements 114, and configured to aid in the prevention of the loosening or raveling of the soil between successive layers of soil reinforcing. In alternative embodiments, the facing 702 may be made of non-metallic materials, including, but not limited to, plastics or ceramics, and do not necessarily have to be arranged in a substantially horizontal to vertical grid-like pattern.

In at least one embodiment, the exemplary facing anchor 700 may include a one-piece device capable of receiving and securely seating at least one transverse wire 118 of the soil reinforcing element 114, and simultaneously connecting to at least one horizontal wire 706 of the facing 702. As illustrated, the facing anchor 700 may include a first side 708 and a second side 710, where each side 708,710 may be connected by a connecting member 712 at one end. The connecting member 712 may include a 180° turn in the facing anchor 700, thereby defining a gap 711 (FIG. 7B) between the first and second sides 708,710. The gap 711 may be configured to longitudinally receive the combination of at least one transverse wire 118 coupled to the longitudinal wires 116. Moreover, the connecting member 712 may also define a vertical slot 713, as will be further discussed below.

Each side 708,710 may define two transverse protrusions 714, however, other exemplary embodiments may define more or less than two transverse protrusions 714 to fit other exemplary applications. A coupling perforation 716 and a trough 718 may also be defined on each side 708,710. In embodiments having two transverse protrusions 714, as illustrated, the coupling perforation 716 of each side 708,710 may be concentrically defined therebetween. Thus, in at least one embodiment, the first and second sides 708,710 can encompass mirror images of each other.

Figure 7A:
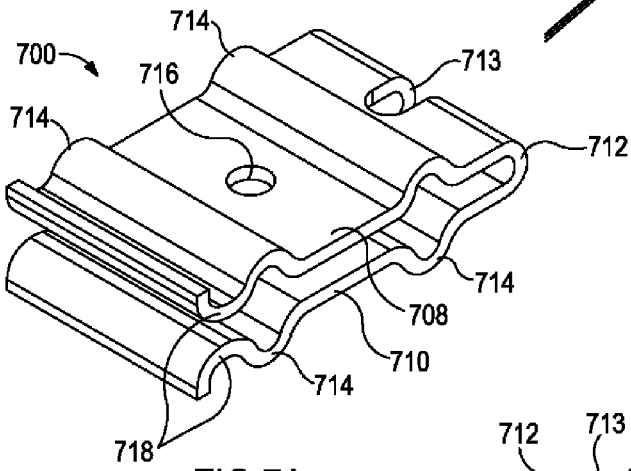
FIG. 7A is an isometric view of the exemplary facing anchor assembly of FIG. 1 with an exemplary connection apparatus, according to one or more aspects of the present disclosure.
Figure 7B:
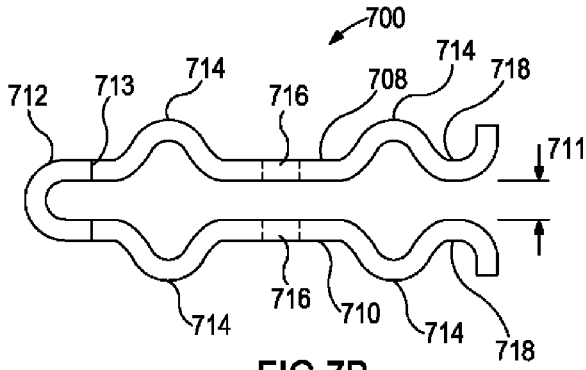
FIG. 7B is a side view of the exemplary facing anchor assembly of FIG. 7A.
Figure 7C:
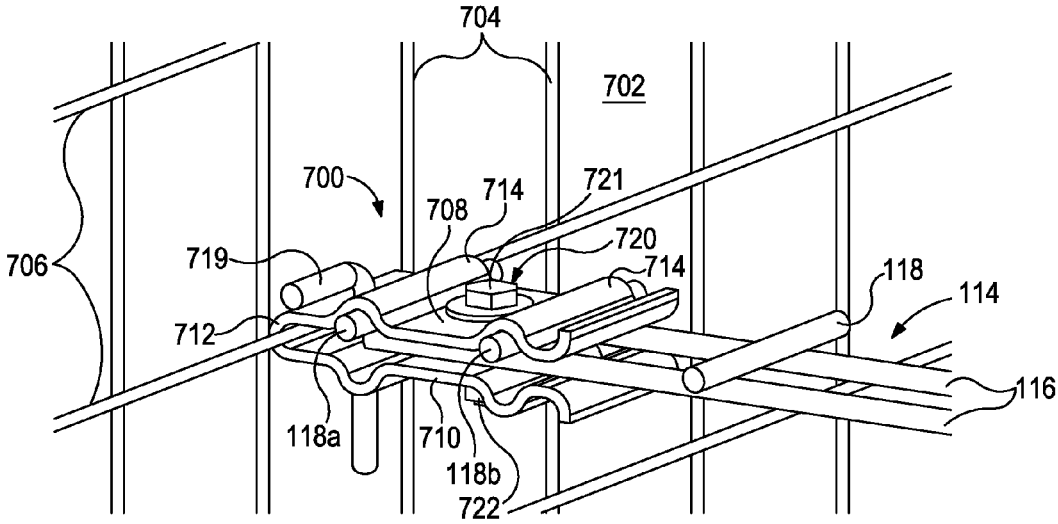
FIG. 7C is an isometric view of the exemplary facing anchor assembly of FIG. 7A coupled to a facing, according to one or more aspects of the present disclosure.

Referring to FIG. 7C, an exemplary method of coupling the facing anchor 700 to the facing 702 is depicted. In at least one embodiment, the connecting member 712 of the facing anchor 700 may be configured to receive, or be hooked on a horizontal wire 706 of the facing 702 between two adjacent vertical wires 704. To secure the facing anchor 700 to the horizontal wire 706, and prevent its removal therefrom, a pin 719 may be inserted into the vertical slot 713 defined in the connecting member 712. In at least one embodiment, the pin 719 may provide a biasing engagement against both the horizontal wire 706 and the vertical slot 713 of the facing anchor 700. In an exemplary embodiment, the pin 719 can be made of a metal and may be bent on one end into a generally L-shaped rod. In one or more embodiments, the pin 719 may be made of bar stock, however, in other embodiments the pin 719 may simply include a length of rebar bent at one end.

Similar to the coupling assemblies 122,310,510,518,610, 612 described above, a coupling assembly 720 may be used to secure a first and a second transverse wire 118*a,b* within the transverse protrusions 714 of at least one side 708,710 of the facing anchor 700. Other embodiments may seat and secure more or less transverse wires 118 to the facing anchor 700, including having transverse wires 118 seated and secured within transverse protrusions 714 of both sides 708,710, or any combination thereof. In at least one embodiment, the coupling assembly 720 may include a bolt and nut assembly having a washer disposed at each end, but may also include other means of mechanical coupling without departing from the scope of the disclosure. In exemplary operation, a bolt 721 may be extended through the coupling perforations 716 (see FIGS. 7A and 7B) of each side 708,710 and a nut 722 may be tightened onto the end of the bolt 721 to clamp down on the longitudinal wires 116, thereby creating a frictional engagement to prevent the removal of the soil reinforcing element 114.

Figure 7D:
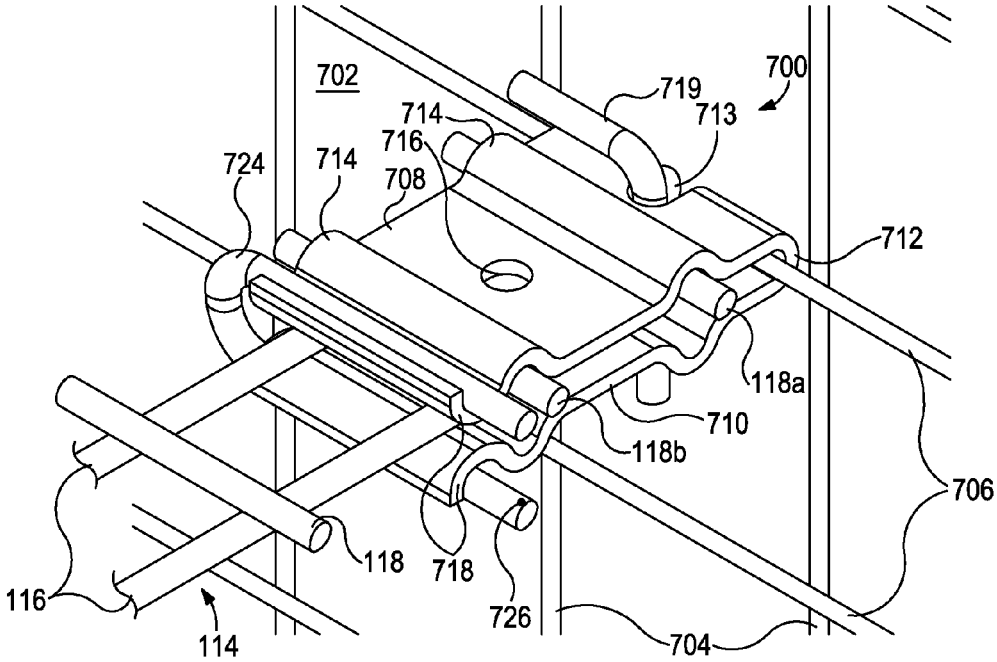
FIG. 7D is an isometric view of the exemplary facing anchor assembly of FIG. 7A coupled to a facing, according to one or more aspects of the present disclosure.

Referring to FIG. 7D, another exemplary method of coupling the facing anchor 700 to a facing 702 is depicted. Similar to the embodiments disclosed in FIGS. 2A and 2B, a U-shaped connector pin 724 may used to secure the sides 708,710 of the facing anchor 700 together, thereby further securing the first and second transverse wires 118*a,b* against removal from the transverse protrusions 714. In exemplary operation, the connector pin 724 may be inserted laterally or longitudinally into the troughs 718 defined on each side 708, 710 of the facing anchor 700. In at least one embodiment, the connector pin 724 may include a small bead 726 disposed on the inside end portion of each leg of the connector pin 724. In one or more embodiments, the bead 726 may include a small globule of welded material and may be configured to prevent removal of the connector pin 724 once in place. Further, the U-shaped connector pin 724 may have at least one end cold-formed to create a knob configured to prevent the removal of the connector pin 724 once engaged with the troughs 718.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

I claim:

1. A facing anchor assembly for securing a facing to a soil reinforcing element, comprising:

a first horizontally-disposed plate and a second horizontally-disposed plate vertically-offset from the first horizontally-disposed plate, each horizontally disposed plate having a first end and a second end;

at least one transverse protrusion disposed between the first end and the second end of each horizontally-disposed plate, wherein the at least one transverse protrusion is configured to receive and seat a first transverse wire of the soil reinforcing element;

a trough disposed at the second end of each horizontally-disposed plate; and a coupling assembly comprising a U-shaped connector pin configured to be inserted longitudinally into the trough of each horizontally-disposed plate, the coupling assembly configured to secure the first transverse wire within the at least one transverse protrusion and further engage a pair of longitudinal wires of the soil reinforcing element between the first and second horizontally-disposed plates, thereby preventing removal of the soil reinforcing element.

2. The facing anchor assembly of claim 1, further comprising a vertical tab disposed at the first end of each horizontally-disposed plate, wherein the vertical tab of each horizontally-disposed plate is cast into the facing.

3. The facing anchor assembly of claim 1, further comprising a vertical tab disposed at the first end of each horizontally-disposed plate, wherein the vertical tab of each horizontally-disposed plate comprises a facing perforation whereby the horizontally-disposed plates are mounted to a back face of the facing.

4. The facing anchor assembly of claim 1, further comprising two transverse protrusions disposed between the first end and the second end of each horizontally-disposed plate, wherein the two transverse protrusions of are configured to receive and seat the first transverse wire and a second transverse wire of the soil reinforcing element.

5. The facing anchor assembly of claim 1, wherein a coupling perforation is defined between the at least one transverse protrusion and the second end of each horizontally-disposed plate.

* * * * *